United States Patent [19]

Berenato, III et al.

[11] Patent Number: 4,555,209

[45] Date of Patent: Nov. 26, 1985

[54] SEMI-AUTOMATIC PUSHER MACHINE LEVELER BAR CONTROL AND METHOD

[75] Inventors: Joseph W. Berenato, III, Bethesda; Earl L. Raivel, Jr., Baltimore; John J. Strepelis, Forest Hill, all of Md.

[73] Assignee: Bethlehem Steel Corporation, Bethlehem, Pa.

[21] Appl. No.: 602,273

[22] Filed: Apr. 24, 1984

Related U.S. Application Data

[63] Continuation-in-part of Ser. No. 508,775, Jun. 29, 1983, abandoned.

[51] Int. Cl.[4] ..... C10B 31/02; C10B 37/02

[52] U.S. Cl. ..... 414/163; 201/40; 202/262; 202/270; 414/587; 414/786

[58] Field of Search ..... 414/587, 786, 162–164; 201/40; 202/270, 262, 263

[56] References Cited

U.S. PATENT DOCUMENTS

| | | | |
|---|---|---|---|
| 1,675,917 | 7/1928 | Thomas et al. | 414/587 |
| 3,616,947 | 11/1971 | Tucker | 201/40 X |
| 3,618,794 | 11/1971 | Helm | 414/587 X |

*Primary Examiner*—Robert G. Sheridan
*Attorney, Agent, or Firm*—William B. Noll

[57] ABSTRACT

A leveler bar for a coke oven is controlled in its travel toward and away from the coke side of the oven by semi-automatic means to move the leveler bar during a "cycle" mode through half strokes and during the "finish" mode it performs four "full" strokes of which a full stroke can mean a ¾ distance of full travel across the oven. Electrical circuitry which modifies or adds to prior art circuitry to accomplish this leveler bar movement is included herein.

15 Claims, 12 Drawing Figures

FIG 1
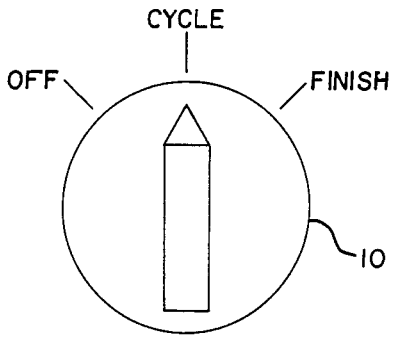
FIG 2
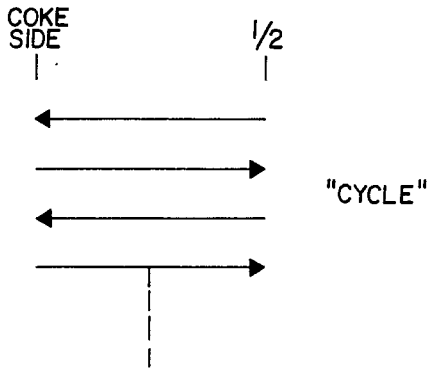
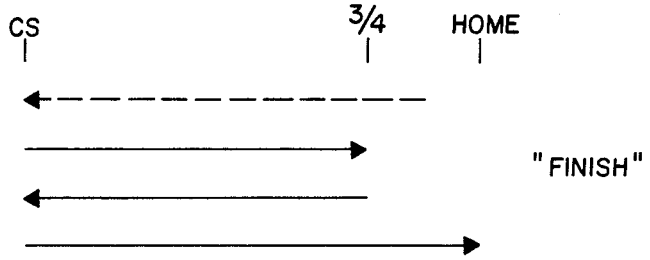
FIG 3

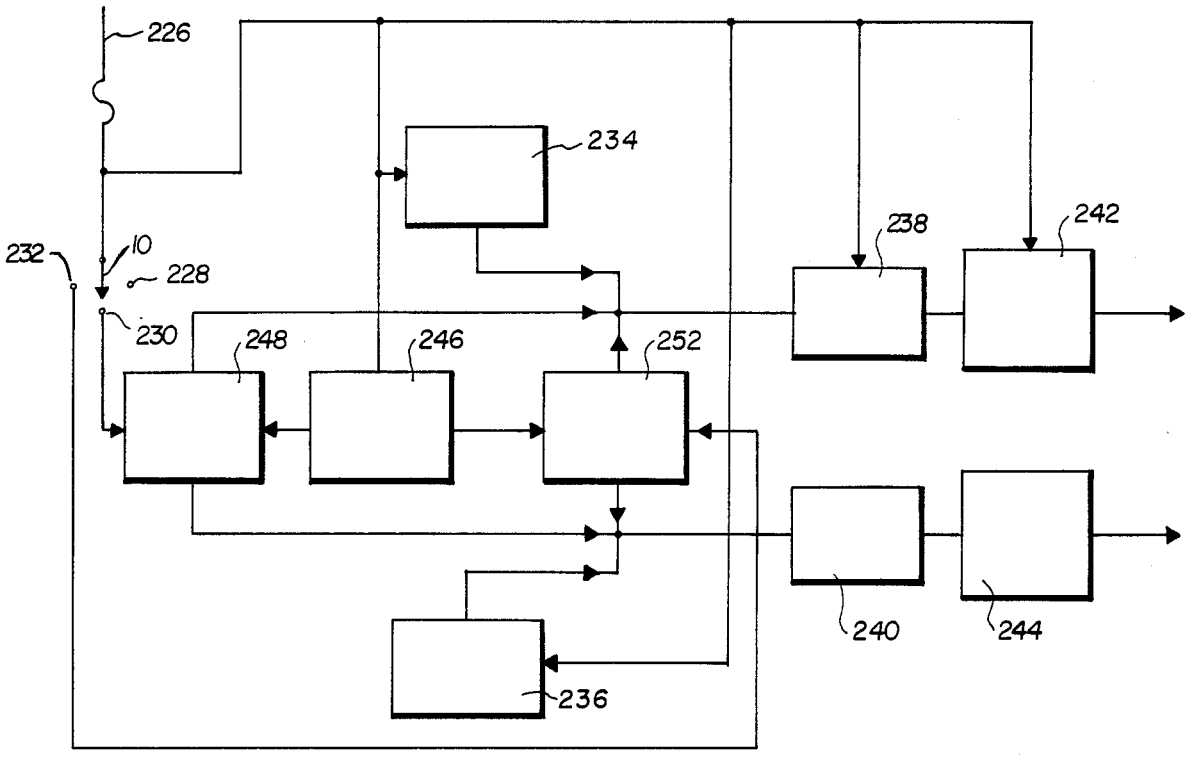
FIG 7
FIG 8
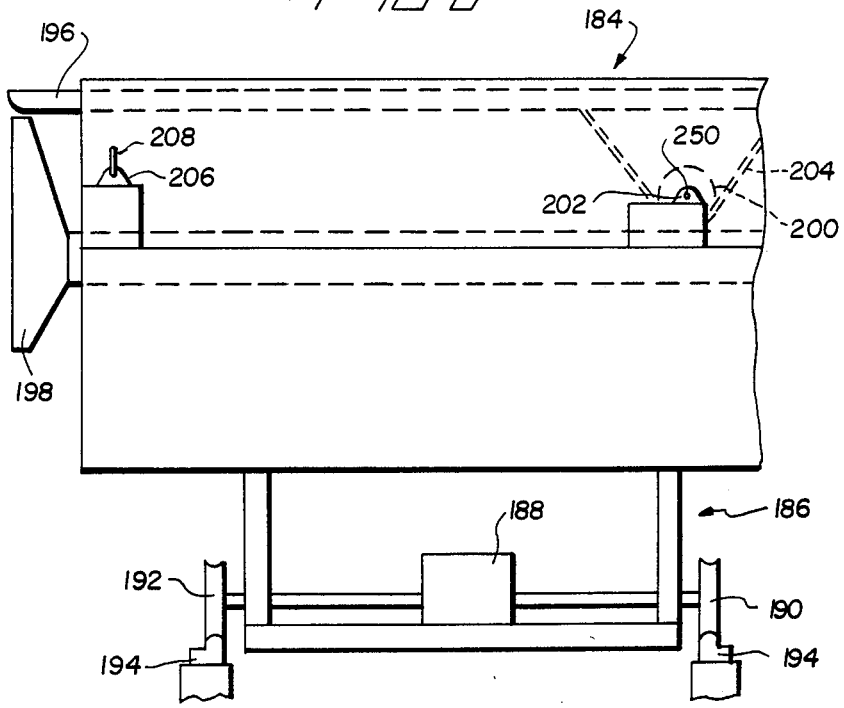

SEMI-AUTOMATIC PUSHER MACHINE LEVELER BAR CONTROL AND METHOD

This application is a continuation-in-part of application Ser. No. 508,775 filed 6.29.83 now abandoned.

BACKGROUND OF THE INVENTION

The present invention relates to a leveler bar control system of a coke battery pusher machine. At present there are pusher machines with controlling electrical circuitry but the present invention includes alterations and additions to prior art pusher circuitry to improve productivity of the coke battery and decrease pollution during charging of a coke oven.

The improved productivity of the coke battery is due to two factors. First, decreased coal spillage or drag-out and, second, decreased leveling time of the coke oven during charging of the oven from a stage-charging larry car.

The present invention provides a method and apparatus for evenly distributing the coal charge while also significantly preventing the introduction of air into the oven during the charging process. Furthermore, the method and apparatus significantly reduce atmospheric pollution generated during the charging of the oven by permitting particulate and gaseous contaminants to be maintained in the closed oven environment.

SUMMARY OF THE INVENTION

It is an object of the present invention to decrease coal spillage by insuring that the portion of the leveler bar which is leveling coal from the larry car hopper being dicharged does not exit at the chuck door. By keeping the leveler bar in the oven being charged, any coal contained in the grids of the leveler bar falls out while the leveler bar is still in the oven. If the leveler bar was partially or fully retracted from the oven then the coal would fall from the bar and would not be available for coking. Consequently, oven throughput is increased by keeping as much coal as possible in the oven.

It is a further object of the present invention to decrease leveling time during charging of the oven.

It is another object of the present invention to have an environmental improvement in the present operation of an oven.

The control of the present invention controls a leveler bar in cycle and finish operations in a novel pattern of movements to complete the leveling operation in a minimum amount of time and with least discharge of oven products into the surrounding atmosphere.

Another object of the disclosed invention is to provide a method and apparatus for minimizing the ingress of air into the closed oven environment.

Still another object of the disclosed invention is to provide a method and apparatus for substantially reducing atmospheric pollution caused by particulates and gaseous components generated during the charging of the coke oven.

Yet a further object of the disclosed invention is to provide a method and apparatus for assuring the generally uniform distribution of the coal charge in the coke oven.

Basically the present invention will minimize use of operator controls in leveling of a coke oven. Stepping switches or a programmable controller, manual and pushbutton controls, selector switches and rotary limit switches can be used to insure that half strokes of the leveler bar are used as needed and that full strokes are used to complete the charge.

BRIEF DESCRIPTION OF THE DRAWINGS

These and other objects and advantages inherent in the invention will be understood from the description in the specification and the accompanying drawings wherein:

FIG. 1 is a control knob with markings to allow practice of the present invention;

FIGS. 2 and 3 are diagrammatic indications of leveler bar strokes in cycle and finish procedures respectively;

FIG. 7 is a schematic view of the control system of the invention;

FIG. 8 is a side elevational view with portions broken away of a pusher machine;

DESCRIPTION OF THE PREFERRED EMBODIMENT

Most coke batteries use a leveler bar to level the coal mass during charging. This invention modifies the existing manually operated leveler bar controls with a semi-automatic control system. Experimentation has shown that the use of half strokes of the leveler bar during the initial part of the charging of the oven optimizes the flow and distribution of the charge of the oven. Upon completion of the charge four full strokes of the leveler bar are necessary to insure that the charge is level and no higher than the coal line of the oven. Use of this invention will insure that half strokes are used as needed; the number of half strokes needed is dependent upon many factors and this invention will make sure that half strokes are used as long as needed. Upon completion of the charge the invention makes sure that only the number of full strokes needed is used.

The three-position selector switch of FIG. 1 is used to select the appropriate operating mode. These positions are marked "off", "cycle", and "finish". "Off" corresponds to manual operation, "cycle" to half strokes, and "finish" to full strokes. The selector switch is tied into a stepping switch which controls the motion of the leveler bar depending upon the operating mode selected. The stepping switch is tied into a rotary limit switch which controls location of the leveler bar in the oven and its speed while in the oven.

To operate the leveler bar it is first inserted approximately two feet into the oven by use of the manual controls; the selector switch 10 is in the off position. At the appropriate time the selector switch 10 is set to cycle position; the leveler bar will proceed to make half strokes in the oven as indicated in FIG. 2 until the selector switch setting is changed. Upon completion of the charge the selector switch is set to finish and the leveler bar makes the four full strokes necessary to complete the leveling operation as indicated in FIG. 3. As indicated by the top dashed line this sequence can be started at any position of the leveler bar. Upon completion of the full strokes the selector switch 10 is set to off; the next cycle is then ready to start.

Figure 4:
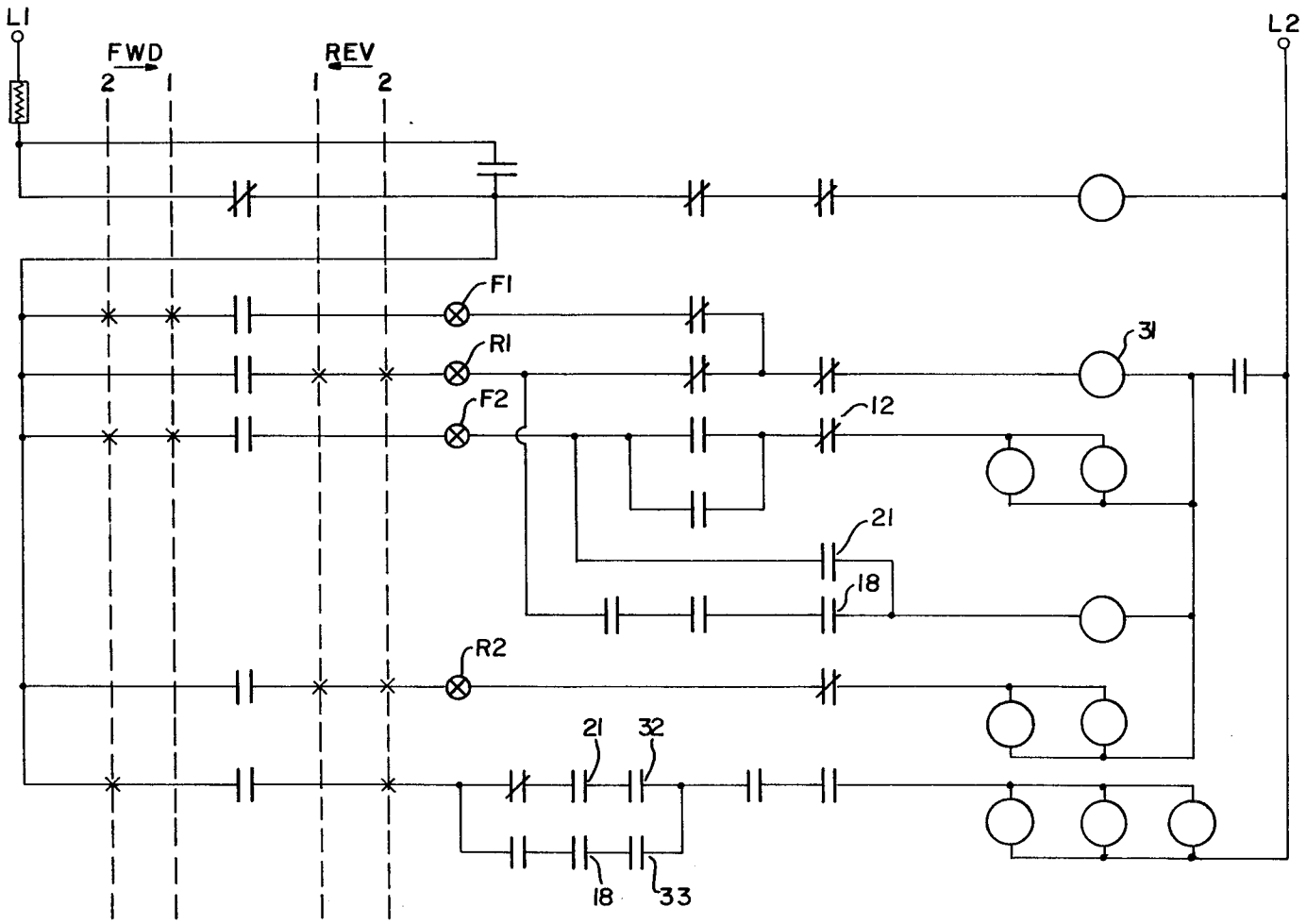
FIG. 4 is a leveler bar drive logic circuitry much of which is used in prior art circuitry to control a leveler bar.
Figure 5:
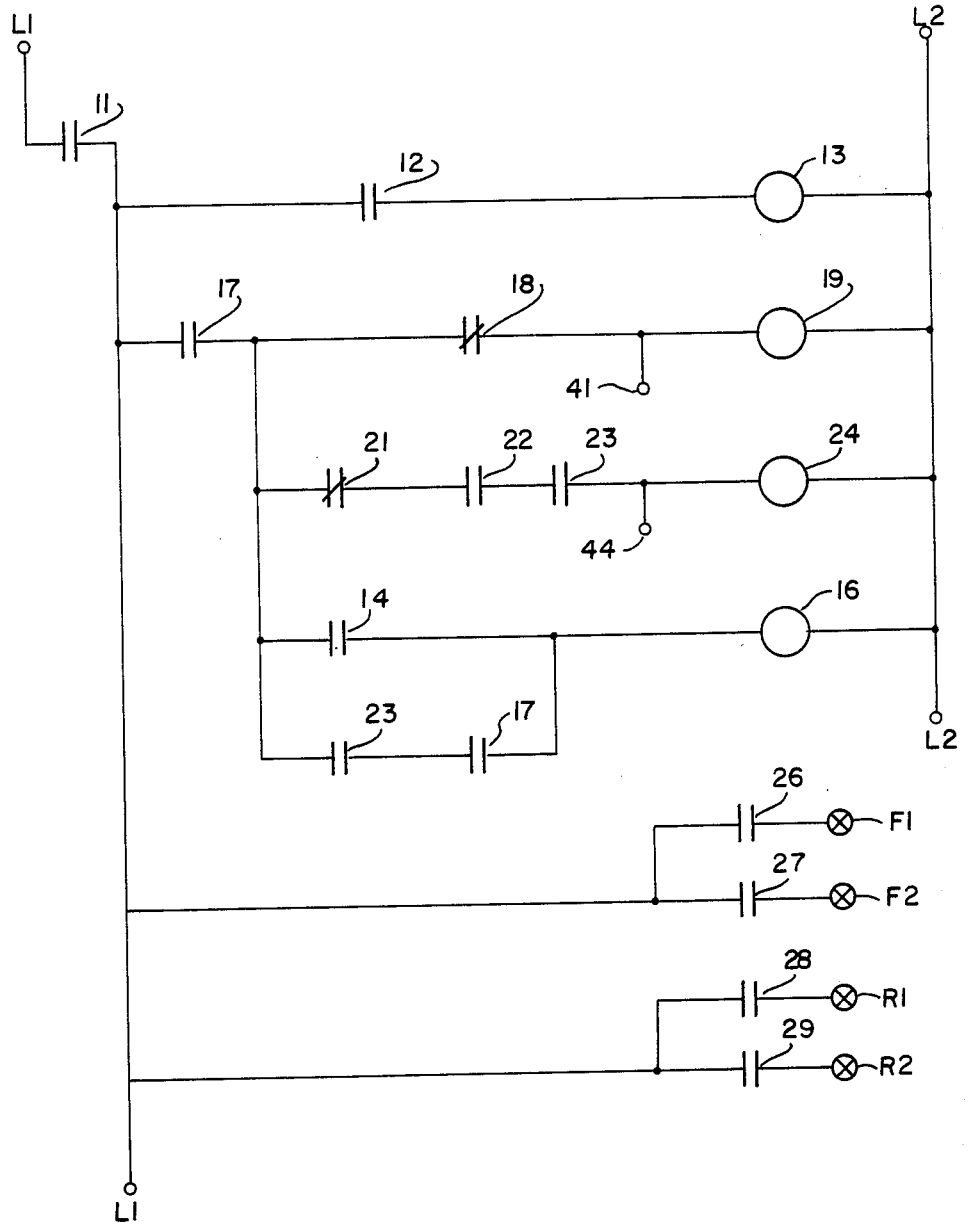
FIGS. 5 and 6 are further circuitry which when connected together with FIG. 4 will perform the leveling in accordance with the present invention.
Figure 6:
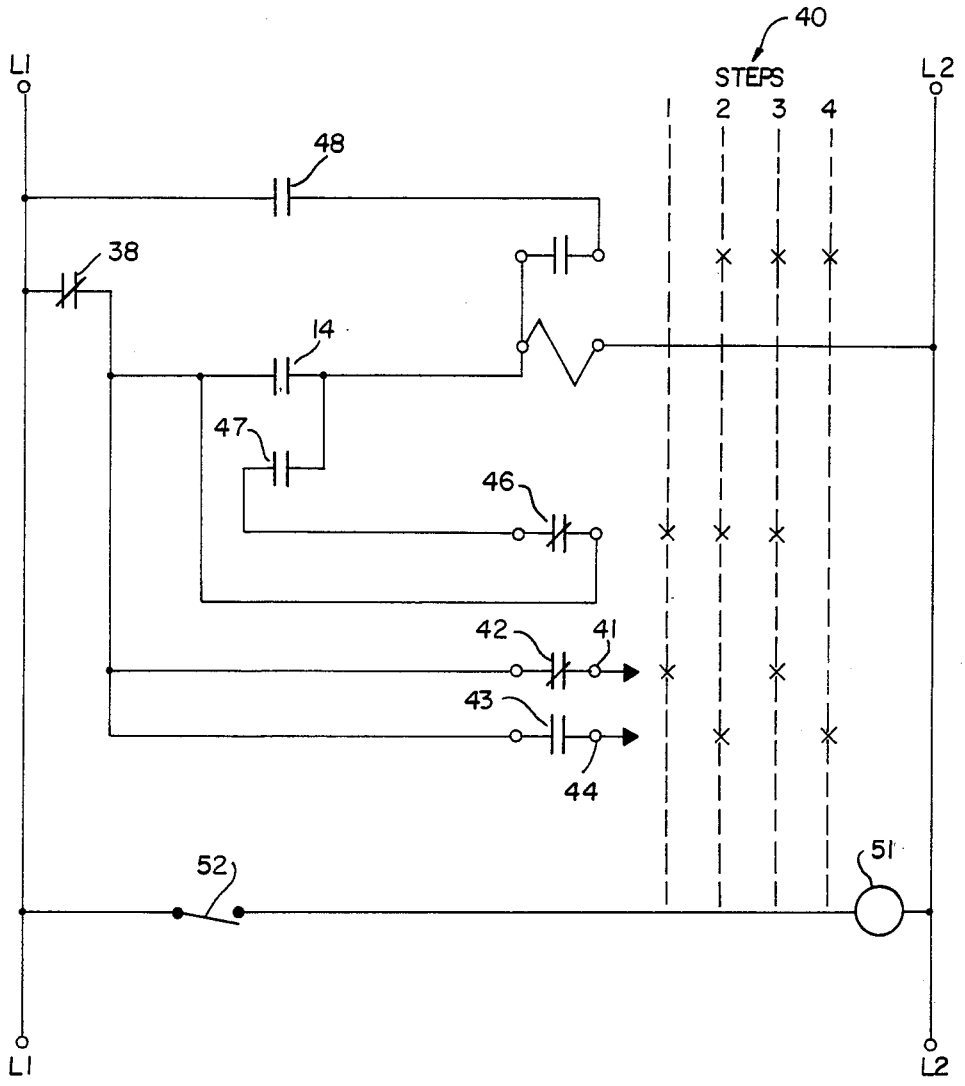

The operation of one form of electrical circuitry to operate the leveler bar in accordance with the present invention is shown in FIGS. 4, 5 and 6.

It is assumed that at the start the travel drive is off and in the stopped position and switch 11 is closed and a cam operated forward travel stop limit switch 12 is closed with the leveler bar in a full forward position. The forward travel stop relay coil 13 is energized, closing forward travel stop relay contacts 14 and energizing forward first relay coil 16.

It should be noted in the circuit diagrams that vertical parallel lines denote relay contacts and the circles denote relay coils. $L_1$ and $L_2$ designate 110 volt and neutral lines respectively. Also connection points F1, F2, R1 and R2 on FIG. 4 are connected to respectively marked points on FIG. 5.

After the leveler bar is inserted into the oven with selector switch 10 of FIG. 1 in the off or manual position, selector switch 10 is now moved to the "cycle" position closing cycle relay contacts 17. In FIG. 1, the X's in the Forward and Reverse end positions 1 and 2 denote closed switches in those positions.

Reverse direction control relay contacts 18 which are open when the leveler bar is traveling in a reverse direction, from coke side to pusher or home side, are now closed and automatic forward relay coil 19 is energized. Forward direction control relay contacts 21, which are open when the leveler bar is moving forward are now closed, ½ stroke limit switch 22 is closed, and forward first relay contacts 23 are closed, thereby energizing automatic reverse relay coil 24.

At this instant connection points F1, F2, R1, and R2 are energized through automatic relay contacts 26 and 27 and automatic reverse relay contacts 28 and 29 respectively. In FIG. 1 relay coil 31 is energized and with travel stop limit switch 12 now open, forward direction control relay contacts 21 and 32 are de-energized and reverse direction control relay contacts 18 and 33 are energized. The leveler bar now travels in the reverse direction from the coke side toward the ½ stroke position.

Forward travel stop limit switch 12 opens as the leveler bar leaves the full forward position and reverse direction control relay contacts 18 open, de-energizing automatic forward relay coil 19. Contacts 18 will open before switch 12 opens. Relay coil 13 is de-energized but forward first relay coil 16 stays energized because forward first relay contacts 23 and cycle relay contacts 17 are still closed. The forward first condition thus stays satified throughout the cycle mode.

Reverse travel of the leveler bar continues until the ½ stroke point limit switch 22 opens. This de-energizes automatic reverse relay coil 24. Reverse direction relay coils 34 and 35 are de-energized and reverse direction control relay contacts 18 close, energizing automatic forward relay coil 19 causing the leveler bar to reverse itself and travel in the forward direction, toward the coke side of the oven.

Forward travel of the leveler bar closes ½ stroke limit switch 22 after the forward travel has caused forward direction control relay contacts 21 to open. Forward travel continues until forward travel stop limit switch 12 closes. At that time forward direction relay coils 36 and 37 de-energize. Forward travel stops and forward direction control relay contacts 21 close and automatic reverse relay coil 24 is energized as forward first relay contacts 23 and ½ stroke limit switch 22 are both closed, causing reverse travel.

No matter when the cycle mode is entered in relation to the position of the leveler bar at that instant, it will pick up as described above, except that forward first relay contacts 23 (two sets in FIG. 5) will cause the leveler bar to travel forward first.

At the proper time the operator switches selector switch 10 to the "finish" position, or this can be done automatically.

At this point the leveler bar may be withdrawn or in any intermediate position, but it is in a stopped position. This is indicated by the dashed top line of FIG. 3. In any case the leveler bar first travels forward toward the coke side of the oven. The "finish" mode of FIG. 3 is controlled in one embodiment by the circuit of FIG. 6 in conjunction with the other circuits shown. The X's under the four Steps are shown to indicate that the contacts on that same horizontal line are closed for that particular step of a sequencing step switch 40.

In starting the "finish" mode by switching selector switch 10 to "finish" position, finish relay contacts 38 are closed and the circuit of FIG. 6 is energized. After last use of this circuit sequencing step switch 40 would have been reset by the circuit to Step position 1.

In the Step 1 position, automatic forward relay coil 19 is energized through connection 41 by the closing of contacts 42 by the step switch 40 causing forward travel of the leveler bar. Travel continues until forward full travel stop relay contacts 14 are closed by the leveler bar having traveled the full forward travel limit of travel. This steps switch 40 to the Step 2 position.

In the Step 2 position contacts 43 are closed causing automatic reverse relay coil 24 to be energized through connection 44 which causes reverse travel of the leveler bar. In this Step 2 of switch 40 contacts 46 are closed and when ¾ travel stop limit contacts 47 are closed, step switch 40 is stepped to the Step 3 position. A ¾ travel stop coil 51 operates step switch 40 in conjunction with limit switch 52 which operates when the leveler bar extends ¾ of the way out of the hole in the oven.

In the Step 3 position of switch 40, contacts 42 are closed thereby energizing automatic forward relay coil 19 through connection 41 causing forward travel of the leveler bar until forward full travel stop relay contacts 14 close at the end of full forward travel of the leveler bar. This steps switch 40 to Step 4.

Again travel is reversed by closing of contacts 43 which energizes automatic reverse relay coil 24 through connection 44. Since contacts 46 are not closed in the Step 4 position of switch 40, switch 40 stays in the Step 4 position and the drive for the leveler bar continues moving the leveler bar in the reverse direction away from the coke side of the oven until it is interrupted by a normally used home limit switch. The "home" position of the leveler bar is a position to permit the leveler bar and the machine to which it is attached to travel in a vertical direction. Switching out of the "finish" mode with selector switch 10 resets contacts 48 to reset step switch 40 to the Step 1 position with contacts 49 which were closed in all steps except Step 1 thus keeping stepping switch 40 in Step 1 until its next cycle through the "finish" mode.

The remaining sets of contacts and relay coils identified in FIG. 4 by parallel lines and circles respectively, but no legends, are merely limit switches and contacts and coils to speed up and slow down the leveler bar along its path of travel as found in prior circuitry for leveler bars.

Due to the present invention oven productivity is further increased because of decreased leveling time during charging of the oven. It has also been found that leveling of coal discharged from the hopper of a stage-charging larry car is minimized if half-strokes of the leveler bar are used. This decreased leveling time is attained by insuring that the active portion of the leveler bar is kept in the oven and consequently travel time of the leveler bar is decreased. If the leveler bar were withdrawn more than proposed in the present invention then this excess time would increase cycle time without contributing any corresponding benefit.

Environmental improvement is due to keeping the leveler bar in the oven as long as needed and by preventing the leveler bar from being prematurely withdrawn from the oven. During leveling of a coke oven a smoke sleeve extends from the pusher machine and meets with and seals the oven door chuck door. The leveler bar passes through a slot in the smoke sleeve and passes into the coke oven through the chuck door. The sealing of the chuck door by the smoke sleeve and the insertion of the leveler bar through the smoke sleeve slot minimizes the infiltration of air into the oven. Control of air infiltration into the oven during charging is important as any air infiltrating the oven must be evacuated. Consequently, this air increases the amount of oven atmosphere which must be withdrawn during charging. The invention insures that the leveler bar is always in the smoke sleeve slot during charging and therefore minimizes air infiltration.

A programmable controller may be used in lieu of the stepping switch 40. Some other type of limit switch may be used in lieu of the rotary limit switch such as a programmable controller. Appropriate pushbuttons may be used in lieu of the manual controls.

It will be obvious to those skilled in the art that various changes may be made without departing from the scope of the invention and the invention is not to be considered limited to what is shown in the drawings and described in the specification.

While the above described control circuit is shown employing relays, relay coils and hard wiring, one skilled in the art will appreciate that similar control functions may be achieved by utilization of modern electronic equipment, including microprocessors. Consequently, while the preferred embodiment utilizes relays and other electromechanical equipment, the invention herein disclosed and claimed may be practiced with modern electronic equipment without in any way detracting from the overall operational aspects thereof.

Figure 9:
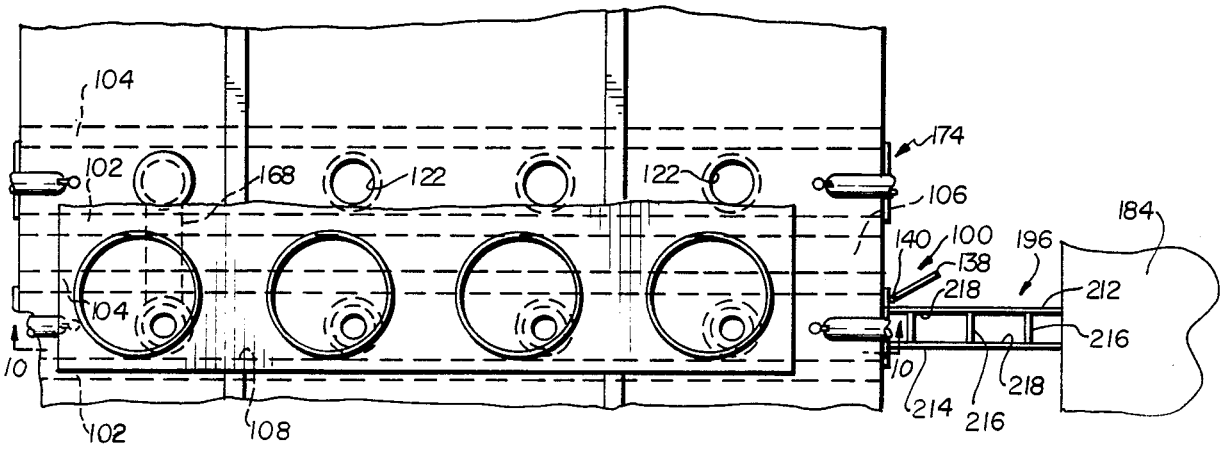
FIG. 9 is a fragmentary top plan view of a coke oven being charged by a charging car.
Figure 10:
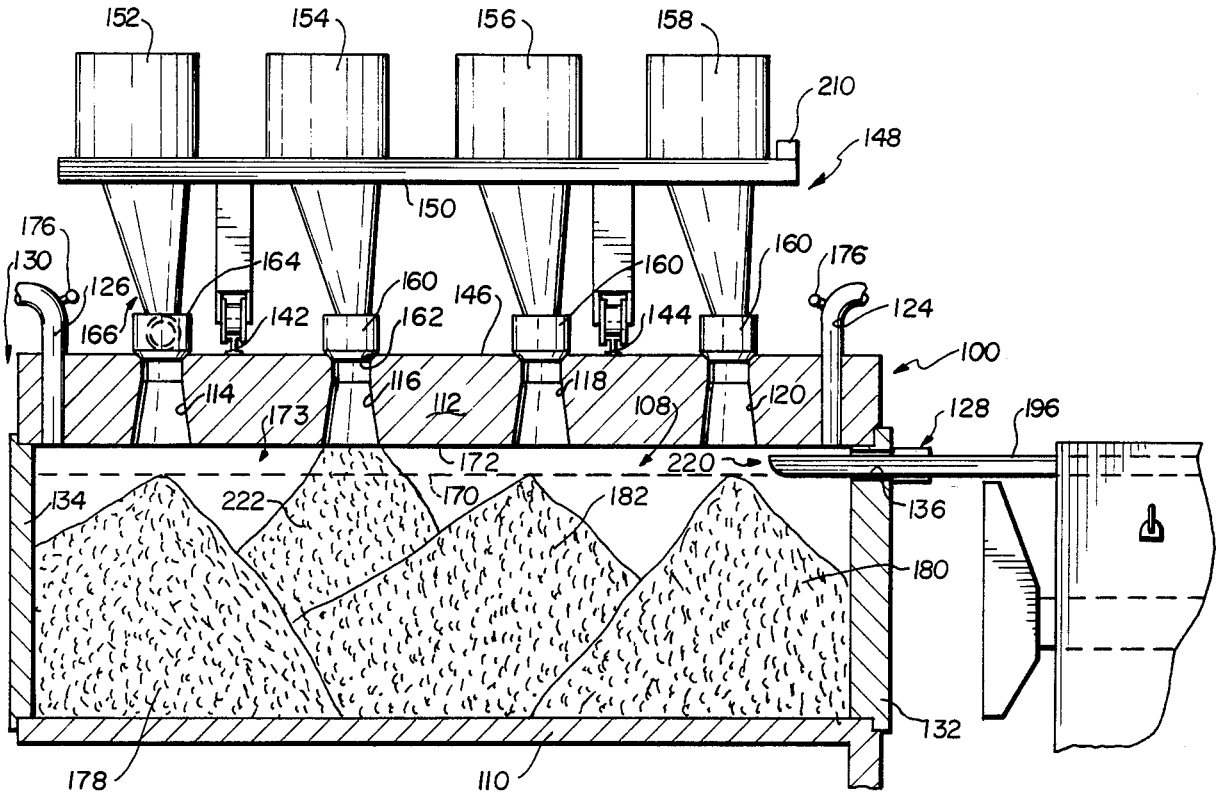
FIG. 10 is a fragmentary cross-sectional view taken along the section 10—10 of FIG. 9 and viewed in the direction of the arrows.

A coke oven 100, as best shown in FIGS. 9 and 10, is a silica refractory structure utilized for distilling coal into coke. Distillation of coal requires that the coal mass be heated to and be maintained for a pre-determined time at approximately 1800° F. in order to assure that the valuable volatile hydrocarbons are driven off. After the valatile hydrocarbons have been driven off, the remaining carbon substance is an amorphous porous material utilized in the manufacture of iron, as well as in other processes. Coal is a complex multicomponent hydrocarbon material. The heating of the coal in the air-free environment of oven 100 results in the generation of large amounts of a gaseous mixture which must be contained in the oven 100 environment in order to prevent atmospheric pollution, as well as to recover the valuable components contained therein.

Generally, a considerable number of ovens 100 are disposed in close parallel relationship with each other in order to provide a coke oven battery. The distillation of coal to coke is a batch-type process requiring 18 hours or more for completion and, therefore, a coke oven battery permits essentially continuous utilization of the oven equipment and machines because of the sequential order used in charging and emptying the ovens.

Figure 11:
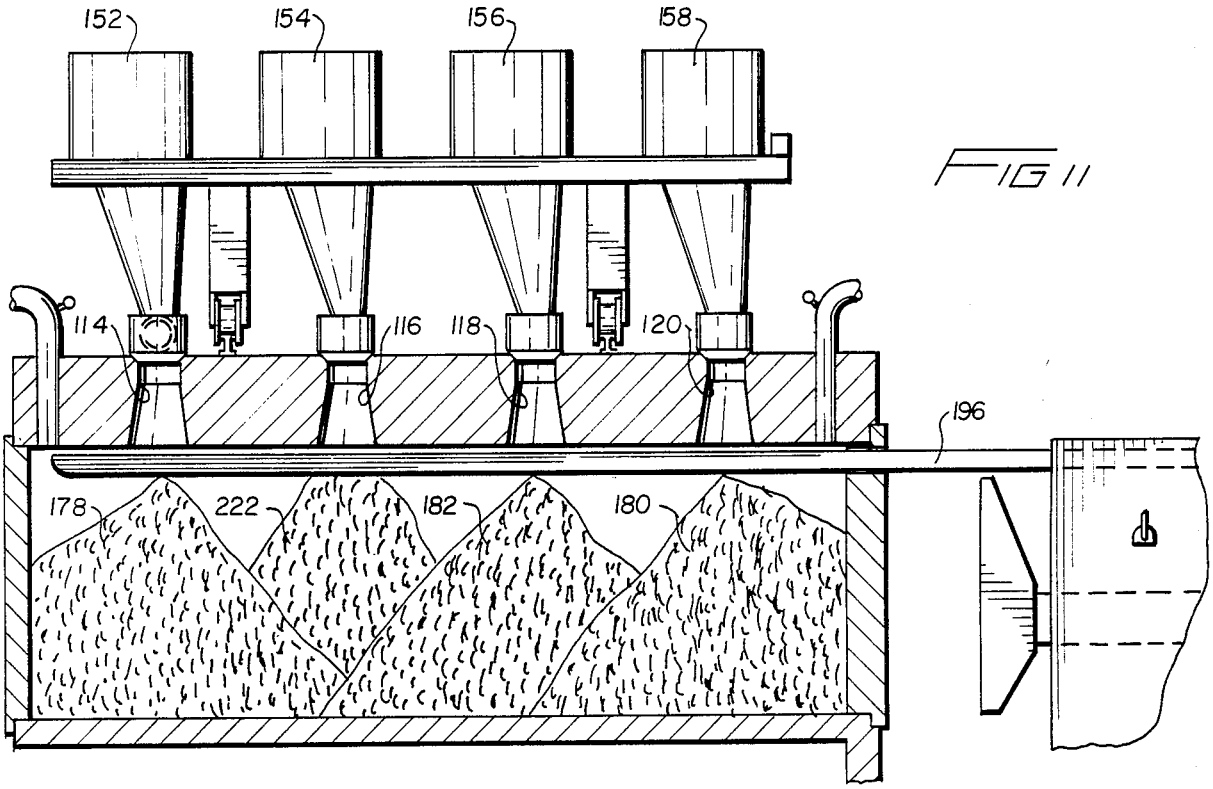
FIG. 11 is another cross-sectional view similar to that of FIG. 10 and with the leveller bar in its extended position; and, FIG. 12 is another cross-sectional view similar to that of FIG. 10 with the leveller bar in its intermediate oven position.

Each of coke ovens 100 has a pair of spaced parallel silica refractory sidewalls 102 and 104. A heating flue 106 is disposed between adjacent oven walls 102 and 104 of adjacent ovens 100 in order to provide the heat utilized in heating the coal mass. Oven 100 has an oven chamber 108 with an oven bottom 110 and an oven top 112. It can be seen in FIGS. 10–12, that oven top 112 includes generally conically downwardly flaring charging holes 114, 116, 118, and 120 which are longitudinally disposed across oven top 112 and which communicate with oven chamber 108. Each of charging holes 114–120 has an associated lid 122 removably sealing its associated charging hole 114–120. Lids 122 permit the holes 114–120 to be opened for thereby permitting coal to be charged into the oven 100. Gas offtake standpipes 124 and 126 communicate with oven chamber 108 through top 112 and permit the gas generated during the distillation process to be conveyed for processing elsewhere. The oven chamber 108 is open at its pusher side end 128 and its coke side end 130. Pusher door 132 is removably secured to end 128 while coke side door 134 is removably secured to coke side end 130. Preferably, pusher side door 132 has a leveller bar opening 136 which is disengagably sealed by pivotal leveller bar door 138 secured to door 132 by hinge 140.

A pair of spaced parallel transverse rails 142 and 144 extend along top surface 146 of top 112 of ovens 100. Rails 142 and 144 extend along battery top 146 and are adapted for guiding a charging car 148 along the battery top 146. Charging car 148 includes a wheeled frame 150 cooperatively associated with rails 142 and 144. Coal receiving hoppers 152, 154, 156, and 158 are secured to frame 150. Each of hoppers 152–158 is generally conically tapered and has a discharge spout 166 at the lower end thereof. Vertically displaceable charging sleeves 160 are slidably mounted to spouts 166 of hoppers 154–158 and are adapted for engaging and sealing with the upper conically flaring end 162 of each of charging holes 116–120. A vertically displaceable jumper pipe 164 is mounted to spout 166 of hopper 152. Jumper pipe 164 has a duct 168 adapted for permitting gaseous and particulate contaminants to flow therethrough. Duct 168 of jumper pipe 164 is of sufficient length and size to span battery top 146 between two adjacent charging holes 114 of adjacent ovens 100. In this way, removal of oven lids 122 from two adjacent charging holes 114 will permit the gaseous and particulate components to be communicated therebetween for reasons to be herein explained.

Prior to the staged charging of oven chamber 108, charging car 148 travels along rails 142 and 144 to a coal supply location (not shown). Preferably, the coal has been crushed to a pre-determined size and treated in order to permit rapid distillation and to improve flowability. Each of hoppers 152–158 is independently filled with a pre-determined amount of coal. The amount of coal cumulatively filling hoppers 152–158 is essentially equal to the volume of oven chamber 108 between coal line 170 and bottom 110. The space between coal line 170 and lower surface 172 of top 112 must be kept free in order to permit the flow of the gaseous and particulate mixture to standpipes 124–126. Should coal extend above coal line 170, then the possibility of atmospheric pollution is significatnly increased. The continuously generated gas will increase the oven pressure to such an extent, should the gas space 173 be blocked, that pollution will leak around lids 122 of charging holes 114–120. Consequently, the volume of coal supplied to chamber 108 must be regulated and any excess must be removed if atmospheric pollution is to be avoided. One skilled in the art will appreciate that the most efficient operation of oven 100 will occur when the coal mass charged into the oven has the upper surface thereof generally aligned with coal line 170 without any dips or valleys. This uniform levelling results in an essentially uniform mass and inhibits the creation of hot spots during the heating by heating chamber 106.

Oven lids 122 must be removed from each of charging holes 114–120, as well as from the adjacent charging hole 114 of oven 174, after the hoppers 152–158 have been filled with their pre-determined supply of coal. Preferably, each of standpipes 124 and 126 includes a gas aspirating valve 176 which is adapted for injecting high pressure gas or steam into each of standpipes 126 and 124 in order to cause the generated gas mixture to be rapidly drawn to and upwardly through the standpipes 124 and 126. Additionally, aspirating valve 176 of standpipe 126 of oven 174 is also opened for the purpose of rapidly drawing the gaseous and particulate contaminates of oven 100 through duct 168 and into standpipe 126.

Charging car 148 is moved along rails 142 and 144 until charging sleeves 160 are vertically aligned with charging holes 116–120. Sleeves 160 are then lowered and sealably engage tapered upper ends 162 of charging holes 116–120. Jumper pipe 164 is lowered and covers charging hole 114 of oven 100 as well as charging hole 114 of oven 174. Hoppers 152 and 158 simultaneously discharge their supply of coal into chamber 108, resulting in peaked piles 178 and 180.

It is preferred that hoppers 152 and 158 discharge their supply of coal before that of hoppers 154 and 156. The charging of the coal is by gravity feed from the hoppers 152–158 with the result that large amounts of dust particulates are generated as the coal moves into oven chamber 108. Furthermore, due to the fine crushing of the coal, some of the coal is rapidly heated by contact with oven walls 104 and 102 with the result that much gas is generated. The coal from hoppers 152 and 158 flows downwardly from charging holes 114 and 120, and has a tendency to partially block gas space 173. Consequently, staged charging of hoppers 152 and 158 permits the particulates and the gaseous components to travel along space 173 to standpipes 124 and 126 with the effect of thereby minimizing atmospheric pollution. Preferably each of hoppers 152–158 includes a sliding valve mechanism at lower end 166. This mechanism prevents gaseous and particulate contaminants from flowing upwardly through hoppers 152–158 after the coal has been discharged into oven chamber 108. Sleeve 160 is raised and lid 122 is moved so as to seal charging hole 120 after hopper 158 is empty.

The coal supply in hopper 156 is then discharged into oven chamber 108 and forms peaked pile 182. After the coal supply in hopper 156 has been discharged into chamber 108, sleeve 160 is raised and lid 122 is replaced on charging hole 118. It should be noted in FIG. 10 that the maximum height of each of peaked piles 178–182 is approximately aligned with coal line 170 to thereby provide an open unrestricted flow path to standpipes 124 and 126.

Pusher machine 184, as best shown in FIG. 8, has a wheeled frame 186 and a motor and gear reduction mechanism 188 connected to wheels 190 and 192 which engage rails 194. Rails 194 are parallel and spaced from each other and from ovens 100 and extend transversely along pusher side 128 of the coke oven battery. Pusher machine 184 has a movable leveller bar 196 and a pusher ram 198, of a type well known in the art. Motor mechanism 200 is connected to rotary limit switch 202 for the purpose of monitoring inward and outward movement of leveller bar 196 between its retracted pusher machine position and its extended oven position. A cable displacement system 204 has the ends thereof connected to leveller bar 196 and cooperates with motor mechanism 200 for inwardly and outwardly displacing leveller bar 196 when operated by controller 206. Controller 206 has a pivotable handle 208 which controls the rotation of motor mechanism 200 for thereby controlling the direction of movement of leveller bar 196.

After coal hoppers 152, 156–158 have discharged their coal into oven chamber 108 and lids 122 have been replaced on charging holes 118 and 120, then leveller bar 196 is aligned with charging hole door 138. Door 138 is opened by pivoting on hinge 140 and the leveller bar 196 is inserted a pre-determined distance, preferably about 2 feet, into oven chamber 108. Charging car 148 has a signal mechanism 210 for sonically informing the operator of pusher machine 184 that the hoppers 152, 156–158 have discharged their supply of coal. Leveller bar 196 may then be inserted into chamber 108.

It can be seen in FIG. 9, that leveller bar 196 includes a pair of spaced parallel side members 212 and 214 which are maintained throughout their height by transverse reinforcing members 216. Consequently, ducts or spaces 218 between adjacent transverse members 216 are open to permit gas flow therethrough, as well as coal to be accumulated therein. Also, as best shown in FIG. 10, leveller bar 196 has a tapered forward end 220 to permit ready passage of leveller bar 196 through coal piles. Insertion of leveller bar 196 through leveller bar opening 136 will substantially block leveller bar opening 136 because of the close sizing therewith and because of transverse members 216. This inhibits and greatly decreases the amount of air drawn into oven chamber 108 by aspirating valve 176. Decreasing the amount of air pulled into oven chamber 108 will also significantly decrease atmospheric pollution. One skilled in the art will appreciate that the greater the amount of air drawn into oven chamber 108 then the greater the amount of gaseous mixture which must be withdrawn from chamber 108 if excessive back pressures, as well as atmospheric pollution, are to be avoided.

After hoppers 152, 154–158 have discharged their coal, and leveller bar 196 has been inserted into oven chamber 108, then the coal supply in hopper 154 may begin to be discharged. Initially, the coal from hopper 154 creates a coal pile 222 which extends upwardly into and blocks charging hole 116. The pile 222 does not spread out and fill the valley between piles 178 and 182 due to the angle of repose of crushed coal. The flow of coal from hopper 154 is stopped by the pile 222 backing up into charging hole 116.

Signal 210 is sounded after flow from hopper 154 is stopped for indicating that leveller bar 196 should be moved across chamber 108 and through pile 222 for thereby leveling and distributing the coal pile 222. The coal from pile 222 accumulates in spaces 218 of leveller bar 196. The coal packed into spaces 218 is moved with the movement of leveller bar 196 and falls therefrom and fills the valleys between adjacent coal piles. It can be noted in FIG. 11, that coal pile 178 has become more horizontal because the coal in pile 222 has been spread toward the coke side.

Figure 12:
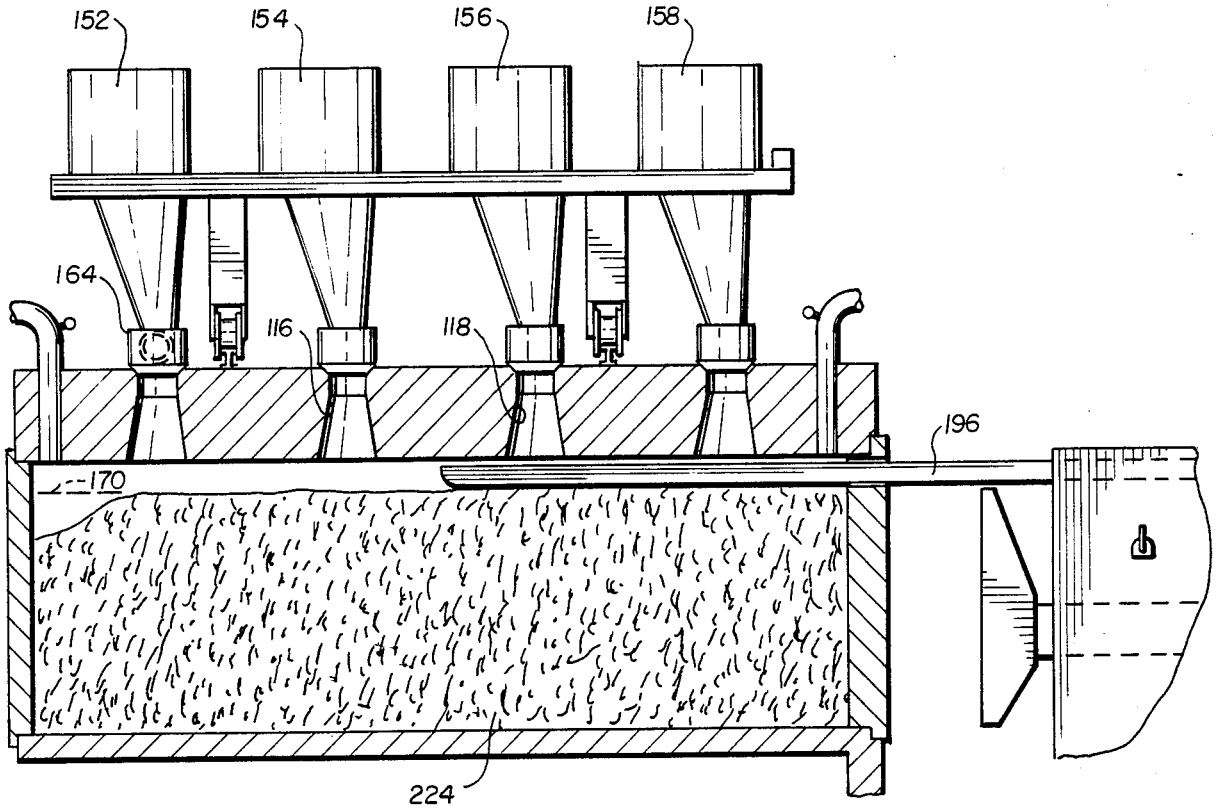

When the leveller bar 196 is adjacent coke side door 134, then the operator turns switch 10 from the off or manual position, as shown in FIG. 1, to the cycle position. The switching of switch 10 from the off to the cycle position causes the leveller bar 196 to repeatedly cycle between the extended oven position, wherein tapered end 220 is closely adjacent coke side door 134, to a point approximately midway between doors 132 and 134. The intermediate position is best shown in FIG. 12, and it can be seen that leveller bar 196 is approximately midway between charging holes 116 and 118 and door 132 and 134. The switches and relays, previously described, control the repeated cyclic reciprocal motion of leveller bar 196 when the switch 10 is in the cycle position and thereby cause the leveller bar 196 to repeatedly move between the coke side position and the intermediate position. This cyclic movement spreads and distributes the coal from pile 222 across the oven chamber 108. The leveller bar 196 is only retracted to its intermediate position because any further retraction toward the pusher machine 184 would withdraw coal from pile 222 through door 136 and thereby increase the amount of oven spillage while decreasing the efficiency of operation. One skilled in the art will appreciate that removal of coal from oven chamber 108, will decrease the oven throughput and cause peaks and valleys across the leveled coal mass 224, as best shown in FIG. 12, with the result that unequal heating of walls 102 and 104 will occur. Furthermore, should the leveller bar 196 be removed from oven 100, then leveller bar opening 136 would be opened and large amounts of atmospheric air would be drawn into oven 100 and thereby increase the amount of atmospheric pollution caused by charging of the oven.

Switch 10 is moved from the cycle position to the finish position after hopper 154 is emptied. Leveller bar 196 then follows the charging sequence shown in FIG. 3.

This sequence assures that the coal mass 224 is generally level along the coal line 170. It can be noted in FIG. 12 that a slight taper occurs at the ends of coal mass 224, particularly toward coke side end 130, but this taper is rather slight. After the switch 10 is moved to the finish position and the cycle designated in FIG. 3 is completed, then the leveller bar 196 is removed from the oven 100 and disposed in its retracted position. Leveller bar door 138 is then closed and sealed. Jumper pipe 164 may then be raised and lids 122 replaced on charging holes 114 of ovens 100 and 174. The aspirating valves 176 are then closed because the naturally occuring pressure caused by distillation of the coal mass 224 will cause the gaseous components to be forced upwardly through standpipes 124 and 126 but with sufficient pressure to leak from lids 122.

The schematic control sequence in FIG. 7 is a simplified form of that shown in FIGS. 4–6. Control power line 226 feeds leveller bar movement configuration selection switch 10. Switch 10, as previously described, has an off contact 228, a cycle contact 230 and a finish contact 232. Each of contacts 228–230 is associated with the circuitry configuration adapted for permitting movement of leveller bar 196 in any one of manual, cycle and finish movement configurations.

Power supply line 226 is connected to manual forward controls 234 and manual reverse controls 236. Manual controls 234 and 236 are energized by pivoting handle 208 of controller 206 and are only operable when switch 10 is in the off configuration wherein contact 228 is engaged. Forward interlock controls 238 and reverse interlock controls 240 are connected, respectively, to forward and reverse controls 234 and 236. Forward interlock control 238 is connected to forward control drive circuit 242 which controls the rotation and operation of motor and gear reducer 188 for thereby permitting movement of pusher 184. Similarly, reverse control drive circuit 234 is also connected to motor and gear reduction unit 188 in order to control the movement in the reverse direction of pusher machine 184. Position sensing control mechanism 246 which is identical to rotary limit switch 202 is connected to each of manual forward and reverse controls 234 and 236 and to forward and reverse interlocks 238 and 240. Interlocks 238 and 240 communicate with position sensor 246 and prevent movement, in either the reverse or forward direction, of pusher machine 184 when leveller bar 196 is remote from its retracted position, as shown in FIG. 8. Position sensing mechanism 246 thereby prevents damage to leveller bar 196 by premature motion of pusher machine 184.

Cycle control circuit 248 is connected to contacts 230, as well as to position sensing means 246, and causes leveller bar 196 to reciprocally cycle between its extended oven position and its intermediate oven position. Control circuit 248 communicates with position sensing mechanism 246 and monitors the location of tapered end 220 for thereby assuring that the leveller bar 196 follows the pre-described cycle configuration, as best shown in FIG. 2.

Rotary limit switch 202 has a rotating shaft 250 aligned with the shaft of motor mechanism 200. A plurality of contacts are arrayed along shaft 250 and each of the contacts is associated with the tapered end 220 being a pre-determined position in oven chamber 208. Consequently, the opening and closing of the contacts on shaft 250 permits precise control and precise monitoring of the location of tapered end 220 of leveller bar 196. While a rotary limit switch 202 is described, one skilled in the art will appreciate that there are various other position sensing mechanisms which may be utilized without detracting from the scope of this invention.

When switch 10 is moved from the cycle to the finish configuration the finish control circuit 252 is energized. Control circuit 252 causes the leveller bar 196 to move in the finish movement confirguration shown in FIG. 3. The finish control circuit 252 is connected to contacts 232 and communicates with position sensing monitor 246 in order to maintain precise control over the movement of leveller bar 196. Stepper switch 40 is connected to circuit 252 and is adjustable so as to selectively vary the number of steps and thereby the number of strokes of leveller bar 196.

It can be seen in FIG. 7, that both the cycle control circuit 248 and the finish control circuit 252 are operatively associated with the forward and reverse interlocks 238 and 240. This arrangement assures that transverse motion of pusher 184 will not be permitted while the leveller bar 196 is being moved in these movement configurations.

While this invention has been described as having a preferred design, it is understood that it is capable of further modifications, uses and/or adaptations of the invention following in general the principles of the invention and including such departures from the present disclosure as come within known or customary practice in the art to which the invention pertains, and which may be applied to the central features hereinbefore set forth, and fall within the scope of the invention of the limits of the appended claims.

We claim:

1. The method of distributing coal charged into a coke oven from a charging car on an upper level of the coke oven, said oven including spaced oven walls and a coke side door removably mounted at one end of said oven and a pusher side door removably mounted at an opposite end of said oven, said pusher side door includes a leveller bar door aligned with the coal line of the oven, and a leveller bar adapted for distributing the coal is movably disposed on an associated pusher machine adjacent the pusher side door, comprising the steps of:

(a) supplying said charging car with a predetermined supply of coal;

(b) charging a pre-determined portion of said supply into said oven for thereby partially charging said oven;

(c) opening said leveller bar door;

(d) positioning said leveller bar in said oven generally a pre-determined distance from said pusher side door;

(e) commencing charging the coal remaining in said charging car into said oven;

(f) moving said leveller bar to generally said coke side door;

(g) repeatedly cycling said leveller bar between said coke side door and generally midway of said oven while said charging continues and thereby distributing said coal in said oven;

(h) moving said leveller bar a pre-determined number of strokes between said pusher side door and generally said coke side door for thereby levelling said coal along generally said coal line;

(i) withdrawing said leveller bar; and, (j) closing said leveller bar door.

2. The method as defined in claim 1, including the further step:

(a) moving said leveller bar to generally said coke side door after the coal has been emptied from said charging car.

3. The method as defined in claim 1, including the further step:

(a) moving said pusher machine to the next oven to be charged after closing of said leveller bar door.

4. The method as defined in claim 3, including the further steps of:

(a) aligning said leveller bar with said leveller bar door; and, (b) signaling to said pusher machine upon completion of charging of said pre-determined portion.

5. The method as defined in claim 1, including the further step of:

(a) signaling to said pusher machine upon completion of charging of said pre-determined portion.

6. The method as defined in claim 1, including the further steps of:

(a) stage charging said pre-determined portion; and, (b) stage charging said remaining supply.

7. A control system for the movable leveller bar of a coke oven pusher machine, comprising:

(a) means for moving said pusher machine;

(b) drive means operatively associated with said leveller bar for reciprocally moving said leveller bar between a retracted position associated with said pusher machine and an extended oven position;

(c) control means associated with said drive means and adapted for selecting any one of off, cycle and finish leveller bar movement configurations;

(d) manual control means operatively cooperating with said drive means and associated with said control means when in said off configuration and adapted for selectively moving said leveller bar;

(e) cycle control means operatively cooperating with said drive means and associated with said control means when in said cycle configuration and adapted for providing continuous reciprocal movement of said leveller bar between said oven position and a first pre-selected position intermediate said oven and said retracted of positions;

(f) position sensing means associated with said leveller bar and connected to said cycle control means for monitoring said leveller bar movement and communicating said leveller bar movement to said cycle control means for thereby permitting control of said leveller bar movement;

(g) finish control means operatively cooperating with said drive means and associated with said control means when in said finish configuration and adapted for providing a pre-determined movement configuration of said leveller bar between said oven and retracted positions;

(h) said position sensing means communicating with said finish control means for thereby permitting control of said leveller bar movement; and, (i) interlock means associated with said means and said position sensing means for preventing movement of said pusher machine when said leveller bar is moved from said retracted position.

8. The system as defined in claim 7, wherein:

(a) said control means includes switch means.

9. The system as defined in claim 7, wherein:

(a) said manual control means includes a manually operated controller having a pivotable handle whereby pivoting of said handle causes associated movement of said leveller bar by said drive means.

10. The system as defined in claim 7, wherein:

(a) said cycle control means includes forward direction relay means associated with said drive means and rearward direction relay means associated with said drive means;

(b) said forward and rearward direction relay means cooperate with said position sensing means; and, (c) said forward and rearward direction relay means are cooperatively associated for causing said leveller bar to be reciprocally moved between said oven and intermediate positions.

11. The system as defined in claim 7, wherein:
(a) said finish control means includes forward finish relay means and rearward finish relay means operatively associated with said drive means and said position sensing means; and,
(b) said forward finish relay means and said rearward finish relay means are operatively associated for reciprocally moving said leveller bar between said oven position and a second intermediate position intermediate said first intermediate and retracted positions.

12. The system as defined in claim 11, wherein:
(a) said finish control means includes adjustable switch means operatively associated with said leveller bar and said forward finish and rearward finish relay means for causing said leveller bar to move a pre-determined number of times between said oven and said second intermediate position.

13. The system as defined in claim 12, wherein:
(a) said adjustable switch means includes a stepper switch.

14. The system as defined in claim 7, wherein:
(a) said position sensing means includes a rotary switch means having a plurality of contacts, each of said contacts associated with a pre-determined movement of said leveller bar.

15. The system as defined in claim 7, wherein:
(a) said interlock means includes at least a first limit switch adapted for sensing movement of said leveller bar from said retracted position.

* * * * *